United States Patent [19]

Weltz

[11] Patent Number: 4,825,506

[45] Date of Patent: May 2, 1989

[54] BIBLECASE AND BOOKCOVER

[76] Inventor: Nathan Weltz, 16 Fenimore Rd., Scarsdale, N.Y. 10583

[21] Appl. No.: 218,971

[22] Filed: Jul. 14, 1988

[51] Int. Cl.[4] ..... A45C 13/26; A45C 3/02

[52] U.S. Cl. ..... 16/115; 16/124; 150/129; 150/130; 190/115; 190/125; 190/127; 383/14

[58] Field of Search ..... 16/115, 124; 150/127, 150/129, 130; 190/115, 124, 125, 127; 384/14

[56] References Cited

U.S. PATENT DOCUMENTS

| | | | |
|---|---|---|---|
| 1,984,122 | 12/1934 | Felmann | 150/130 |
| 2,011,880 | 8/1935 | Stein | 383/14 |
| 2,096,895 | 10/1937 | Halpin | 383/14 |
| 2,318,563 | 5/1943 | Smith | 383/14 |
| 2,555,820 | 6/1951 | Satz | 190/125 |
| 2,725,088 | 11/1955 | Kaplin | 150/129 |
| 2,769,474 | 11/1956 | Klotz | 190/115 |
| 4,239,074 | 12/1980 | Kahn | 190/127 |
| 4,714,143 | 12/1987 | Saliba | 190/115 |

*Primary Examiner*—Nicholas P. Godici
*Assistant Examiner*—Edward A. Brown
*Attorney, Agent, or Firm*—Lilling & Greenspan

[57] ABSTRACT

An improved case handle structure for a folding case with a retractable handle, wherein the improvement comprises a case made of multiple layers consisting of an inner lining, a first stiffening element, a foam element, a second stiffening element and an outer skin, and wherein the legs of the retractable handle are movably positioned between the first stiffening element and the foam element.

6 Claims, 3 Drawing Sheets

FIG.1
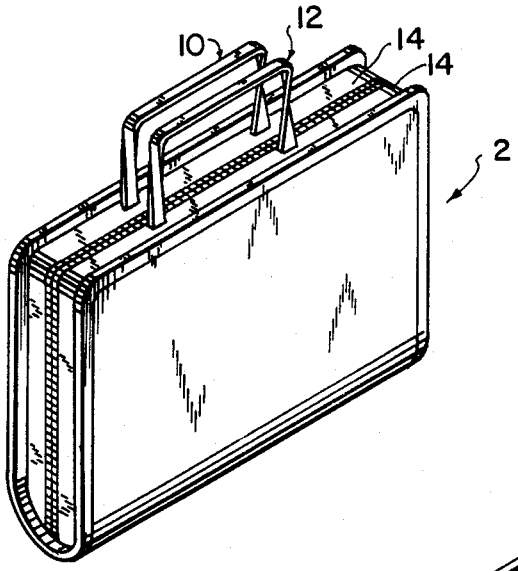
FIG.2
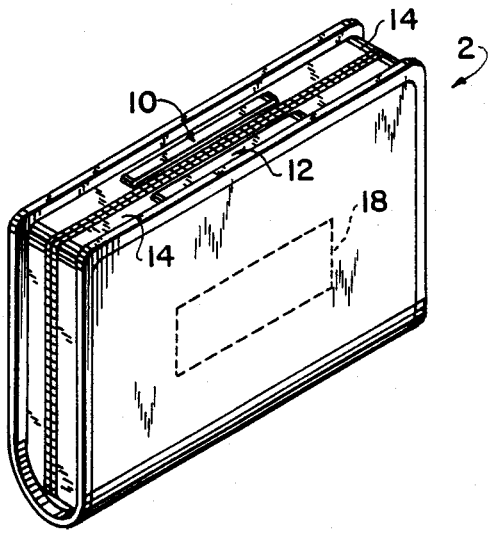
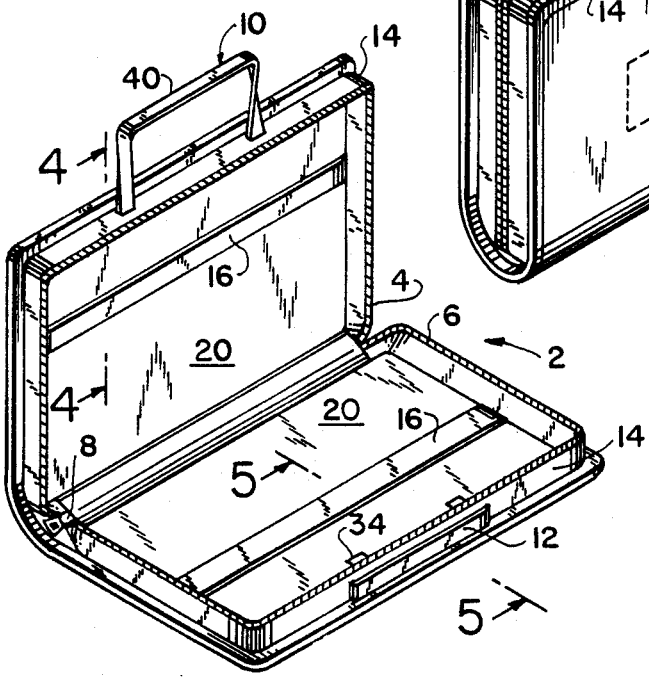
FIG.3

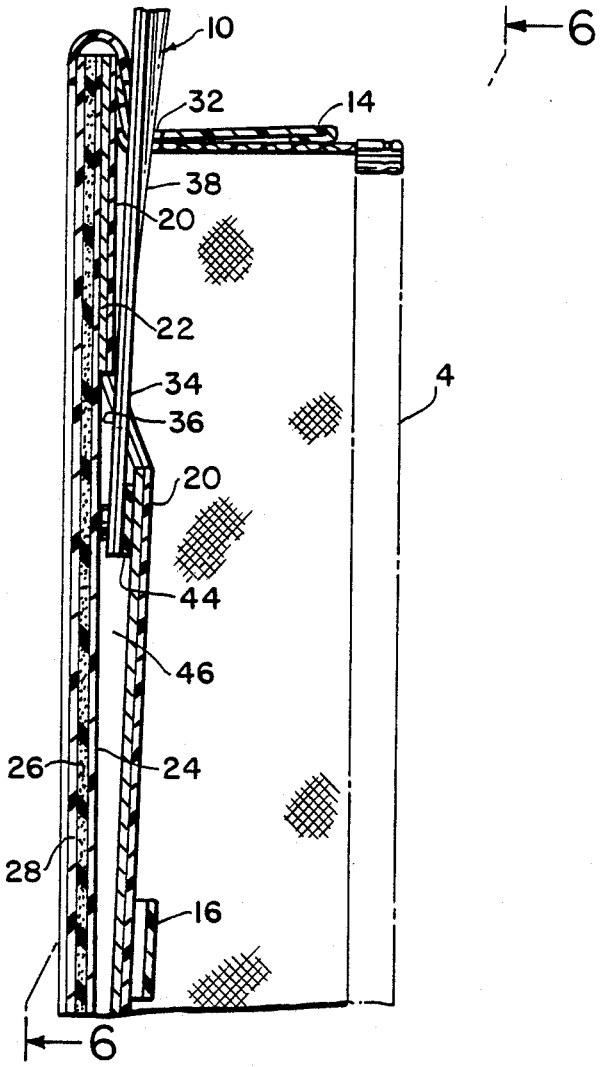
FIG.4
FIG.5
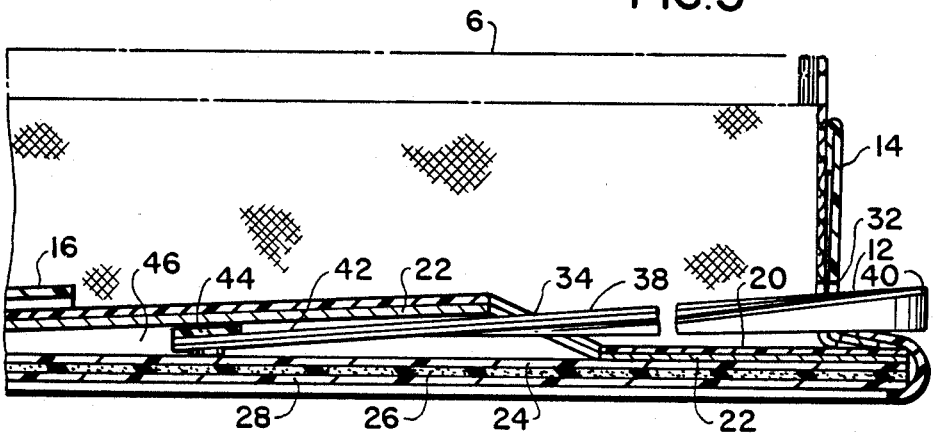

BIBLECASE AND BOOKCOVER

BACKGROUND OF THE INVENTION

Small attache cases, referred to as biblecases, have become very popular for holding bibles or other books. It is desirable for such cases to include handles to make them easier to transport. Since the handles can be unsigthly, it has proven desirable to provide such cases with handles which can be concealed when not in use. This is typically done by providing a pocket on the outer surface of the case into which the handles may be pushed when not in use. This structure is not desirable, however, in the case of biblecases. This is because the pocket on the outer surface of the case would be so big to hold the handles that the outer portion of the case would be just one big pocket and it would not be esthetically pleasing. This problem has not been presented with respect to attache cases and briefcases, because the case is so large and the pocket for the handle so relatively small, that the pocket has not presented a problem to the aesthetics of the case.

There is a need in the industry for concealable handles without the need for providing an unsigthtly pocket on the outer surface of the case.

SUMMARY OF THE INVENTION

This is accomplished by providing a multi-layered biblecase, so that a pocket is defined between the layers of the case into which the handles may be pushed and concealed. Though this invention is disclosed with respect to biblecases and bookcovers in which it has it greatest application, it may also be used for any briefcase or attache case of any size, shape and configuration.

BRIEF DESCRIPTION OF THE DRAWINGS

FIG. 1 is a perspective view showing the improved biblecase handle structure of this invention with the handles in a work position.

FIG. 2 is a perspective view of the improved biblecase handle structure of this instructure with the handles concealed.

FIG. 3 is a perspective view of an open biblecase showing the improved handle structure of this invention with one handle concealed and one handle in the work position.

FIG. 4 is a cross-sectional view taken along lines 4—4 of FIG. 3.

FIG. 5 is a cross-sectional view taken along lines 5—5 of FIG. 3.

DETAILED DESCRIPTION OF THE INVENTION

Figure 6:
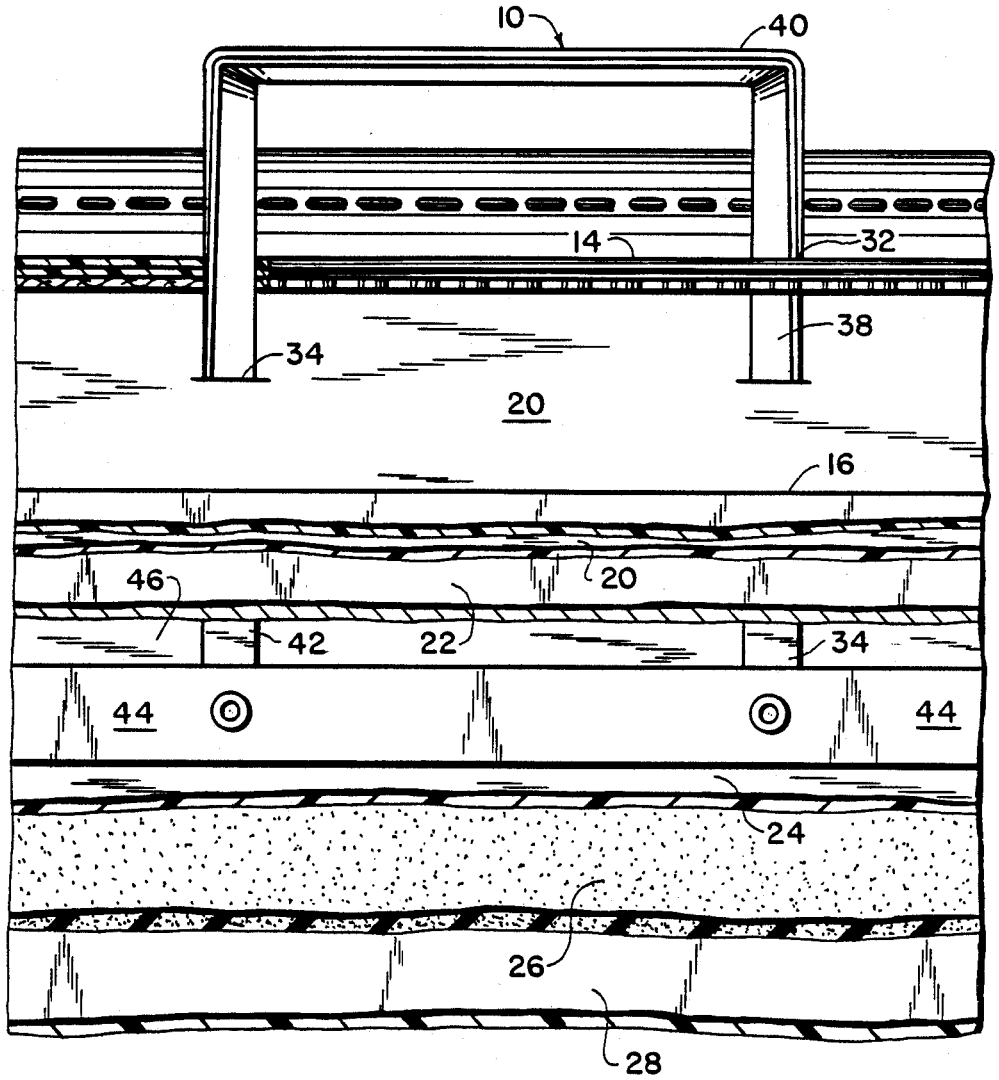
FIG. 6 is a cross-sectional view taken along lines 6—6 of FIG. 4.

The improved handle structure of this invention can be used with any briefcase or attache case of any size, shape or configuration, though it has particular application to biblecases and bookcovers. More particularly, a typical bible case would be a small folding attache case, but flaps could be inserted in the inside, so that it can also serve as a book cover, as opposed to merely a case. It also has application for cases made of any material, such as leather or plastic or any other material.

The invention works with a case of the folding type which has two halves 4 and 6 which can be folded together and secured by means of a zipper in a conventional fashion. Cases of this type are well known, as are the methods of construction. Such cases typically have handles 10 and 12 which extend outward from the top portions of the two halves 4 and 6.

Just as the case itself can be made of any material, the handles may be made from any suitable material, such as leather or plastic.

If desired, a strap 16 may be provided on the inside of the halves 4 and 6 in order to secure papers, but this has no bearing on the handle structure. In addition, if desired, a pocket 18 may be provided on the outer surface of one or both of the halves 4 and 6. This also will have no bearing on the structure of the handles.

The case is constructed of multiple layers. The innermost layer is the lining 20, and this may be made from any material that would be used for the inside lining of a case. Underneath the lining 20 is a stiffening element 22 which may be made from any semi-rigid material, such as cardboard. Underneath the stiffening element 22 is a foam material 24 to add body to the case. Then there is a second stiffening element 26, which may be made from hard plastic or cardboard, and outside of the second stiffening element 26 is the outer skin 28 of the case. As mentioned, the outer skin 28 may be made from leather or plastic or any other suitable material for the outer skin of a case.

If a pocket 18 is provided on the outer surface of one or both of the halves 6 (as shown in FIG. 2), between the second stiffening element 26 and the outer skin 28 there would be an additional lining material 30.

As best shown in FIGS. 4, 5 and 6, the handles 10 and 12 extend through an opening 32 in the top portions 14 of the halves 4 and 6 and extend into the interior of the case 2.

The handles 10 and 12 are made in the same fashion and both are essentially U-shaped and may be made in any manner known in the industry. The top portion 40 serves as a grip and the legs 38 extend downward and through the top portion 14 of the halves 4 and 6. The legs 38 would then pass through an opening 34 in the lining 20 and an opening 36 in the stiffening element 22 and the lower ends 42 of the handles 10 and 12 would be positioned between the stiffening element 22 and the foam material 24. A strap 44 may be used, if desired, to hold the lower ends 42 of the legs 38 of the handles together, so there is no spreading.

When the handles 10 and 12 are in their concealed position (see FIGS. 3 and 5), the lower ends 42 of the legs 38 of the handle 12 are pushed all the way down within the multi-layer case and the grip 40 is essentially flush with the top portion of the case.

To raise the handle to a working position (as shown in FIGS. 1 and 4), the grip 40 is held by the user and the legs 38 may be pulled from within the pocket 46 defined between the stiffening element 22 and the foam element 24. The handle is pulled until it reaches its fully extended position, as shown in FIG. 1. In this connection, the strap 44 would be useful to prevent the handles from been pulled out from within the pocket 46.

I claim:

1. An improved case handle structure for a folding case with a retractable handle, wherein the improvement comprises a case made of multiple layers consisting of an inner lining, a first stiffening element, a foam element, a second stiffening element and an outer skin, and wherein the legs of the retractable handle are movably positioned between the first stiffening element and the foam element.

2. An improved handle structure according to claim 1, wherein said inner lining is the innermost layer of said case, said first stiffening element is positioned adjacent an outer surface of said inner lining, said foam element is positioned next to an outer surface of said first stiffening element, said second stiffening element is positioned next to an outer surface of said foam element and said outer skin is positioned adjacent an outer surface of said second stiffening element and is the outermost layer of said case.

3. An improved handle structure according to claim 1, wherein the legs of the retractable handle are U-shaped and have legs that extend through openings in the inner lining and the first stiffening element and the distal ends of the legs are positioned in a space defined between the first stiffening element and the foam element.

4. An improved handle structure according to claim 2, wherein the legs of the retractable handle are U-shaped and have legs that extend through openings in the inner lining and the first stiffening element and the distal ends of the legs are positioned in a space defined between the first stiffening element and the foam element.

5. An improved handle structure according to claim 3, further comprising a strap connecting the distal ends of the legs of the retractable handle.

6. An improved handle structure according to claim 4, further comprising a strap connecting the distal ends of the legs of the retractable handle.

* * * * *